United States Patent [19]

Olson, deceased et al.

[11] 4,042,286

[45] Aug. 16, 1977

[54] APPARATUS FOR PROTECTION AND STORAGE OF PHOTOTYPESETTING EQUIPMENT

[76] Inventors: Richard S. Olson, deceased, late of Canby, Minn.; John E. Qualley, executor, P.O. Box 146, Canby, Minn. 56220

[21] Appl. No.: 623,598

[22] Filed: Oct. 20, 1975

[51] Int. Cl.[2] ..... A47F 3/06

[52] U.S. Cl. ..... 312/129

[58] Field of Search ..... 312/129, 330, 234, 306, 312/128, 185, 138, 138 A, 319; 211/41

[56] References Cited

U.S. PATENT DOCUMENTS

| | | | |
|---|---|---|---|
| 213,814 | 4/1879 | Emanuel | 312/330 |
| 1,291,826 | 1/1919 | Garretson | 211/41 |
| 1,433,274 | 10/1922 | Harris | 211/41 |
| 1,755,880 | 4/1930 | Keil | 312/138 R |
| 2,505,898 | 5/1950 | Jaffe et al. | 312/138 A |
| 2,660,506 | 11/1953 | Wright | 312/319 |
| 2,986,281 | 5/1961 | Jordan | 211/41 |
| 3,497,074 | 2/1970 | Shaheen | 312/234 |
| 3,702,132 | 11/1972 | Fites | 206/387 |
| 3,728,662 | 4/1973 | Puri | 211/41 |
| 3,838,777 | 10/1974 | Thornicroft et al. | 211/41 |
| 3,874,756 | 4/1975 | Greene | 312/234 |

*Primary Examiner*—Paul R. Gilliam
*Assistant Examiner*—Victor N. Sakran
*Attorney, Agent, or Firm*—Williamson, Bains, Moore & Hansen

[57] ABSTRACT

An apparatus for the orderly storage and protection of phototypesetting equipment such as fonts and width cards, comprises a cabinet with a closable storage chamber and having one or more generally upright panels within the chamber which are mounted for movement relative to the cabinet between retracted positions wherein the panels are contained wholly within the cabinet and extended positions wherein the panels extend at least partially out of the cabinet. The obverse and reverse sides of each panel are provided with a plurality of pairs of elongated strips, each pair adapted to retain a font therebetween. Each strip includes a mounting flange fixed to the panel and a font retaining web extending outwardly from the mounting flange and terminating in a section generally parallel to and spaced laterally from the panel, each pair of strips being positioned on the panel to define a narrow, elongated receiving compartment closely adjacent the panel and extending in a front-to-rearward direction in the chamber to receive and store both the font and the sheath in which it is normally kept. The compartments are arranged in vertically spaced horizontal rows, and each is constructed to receive and closely confine a single sheath and font in an upright plane parallel to the panel, the compartment preventing lateral movement or bending of the sheath or enclosed font. The door of the font storage cabinet may be provided with a plurality of containers for the width cards which are required for the fonts. Preferably the font storage cabinet is positioned at eye level, and if desired may be supported on a second cabinet which can be used to store other typesetting equipment and whose upper surface provides a convenient work counter on which the fonts and width cards can be assembled or inspected.

6 Claims, 6 Drawing Figures

APPARATUS FOR PROTECTION AND STORAGE OF PHOTOTYPESETTING EQUIPMENT

BACKGROUND OF THE INVENTION

The invention relates to the field of phototypesetting and comprises an apparatus particularly designed for the protection and storage of fonts and width cards as well as most other supplies and materials useful in phototypesetting.

Among the more important items used in phototypesetting and photoprinting are the fonts and width cards which define the style of print and the spacing and arrangement of letters and numbers.

Fonts are elongated, film-like sheets of plastic which contain a complete and compatible set of letters, numbers and punctuation marks usable as a composite type style in printing. Typically, these very fragile and expensive sheets are 3 to 4 inches wide and between two and three feet in length, with a generally blackened surface having transparent letters thereon which permit a light source to pass through the transparent letters of the font to activate photosensitized paper during the printing process. These thin, plastic fonts are easily damaged by excessive dust or abrasive contact of any kind. Accordingly, printers and typesetters exercise continual caution to avoid any scratching of or contact with the delicate font surfaces and endeavor to keep the fonts clean.

Up to now fonts have been stored with only a thin plastic package or sheath surrounding the fonts. No special storage facilities have been available, and accordingly they have often been stored in ordinary drawers or boxes and frequently become scratched and abraded during storage and sorting. Alternatively some printers keep the fonts in close proximity to the photoprinting equipment where the fonts rapidly become dirty or abraded, in which case the resulting short use life is accepted as a business expense. Fonts are frequently changed during the printing operation as different styles of print are utilized. Accordingly they must be readily available to the typesetter with a minimum of searching and unpacking, yet it is certainly desirable to prolong their use lives by storing them in a manner which will protect them from scratching, marring, dust accumulation, bending or other deformation. It has been found most desirable that they be stored in a generally vertical plane flushly against a protective supporting surface. Despite the fragility of the font and the substantial cost of its replacement, there is no known product on the market specifically designed for its protection and storage.

A width card is a generally rectangular, box-like, plastic module containing electronic circuitry for use in conjunction with the fonts. For each font there is a particular matched width card to be used in conjunction with the font to define the spacing and arrangement of letters and numbers. When a particular font is selected, a matching width card is also required to instruct the printing device as to the spacing between letters and symbols contained on the font. Accordingly, the fonts and width cards are used in close association and should be stored in an organized manner in close proximity to one another so as to be readily and easily available to a printer. It is desirable that some mode of indexing be used so that the particular width card needed for a particular font may be easily and unmistakably selected. There are no known products available specifically for storage of width cards or for the storage and protection of both font and width cards in an orderly and systematic arrangement. Because of this unavailability, a printer often must sort through a collection of randomly arranged fonts and width cards to find the desired combination, thus wasting valuable time, producing additional handling of unneeded fonts, and increasing the risk of damage to the poorly stored fonts.

SUMMARY OF THE INVENTION

The invention comprises an apparatus for the orderly storage and complete protection of fonts and width cards, being particularly adapted to provide the protection needed by fonts during storage and also organizing both fonts and width cards in close proximity to one another to make it possible to quickly locate desired fonts and width cards.

The apparatus utilizes a generally rectangular enclosure having an access opening and an interior storage chamber in which the fonts are stored. One or more generally upright panels are positioned within the chamber and means is provided for movably mounting each panel to the enclosure so as to permit movement of the panel between a retracted position, wherein the panel is contained within the chamber, and an extended position, wherein the panel protrudes from the chamber through the access opening. The preferred mounting means retains the panel in a generally upright plane.

Font retaining means are fixed to each panel on obverse and reverse sides thereof to define a plurality of distinct, narrow, elongated compartments closely adjacent to the panel and extending in a front to rearward direction in the chamber, each compartment being constructed to receive and closely confine for storage a single font and the sheath in which it is contained. Each font and sheath are retained in the compartment on a generally upright plane parallel to the panel.

The font retaining means includes a plurality of elongated strips, each strip having a mounting flange fixed to the panel and a font retaining web connected to the mounting flange and extending laterally outward from the panel at an acute angle to the mounting flange so that a font supported on the web will be urged into contact with the adjacent side of the panel. The strips are arranged in pairs with the font retaining webs being vertically spaced apart on the panels, confronting one another and cooperating to retain a font and sheath therebetween with the sheath generally flush against the side of the panel. A stop is provided at the rearward end of each compartment to prevent damage to the font and sheath by rearward over-travel of the font and sheath beyond the rear of the panel. Compartments are arranged on obverse and reverse sides of the panels with the compartments being arranged in vertically spaced, generally horizontal rows.

The enclosure has a door which can be tightly closed to exclude dust and other extraneous materials from the chamber. On the inner surface of the door containers are provided to store width cards, the width card containers being indexed in a manner closely corresponding to the order in which the fonts are arranged on the panels.

Preferably the font storage cabinet is elevated and positioned at eye level. It is desirable to provide a second storage cabinet for other phototypesetting equipment nearer floor level, the second cabinet containing extra paper, cleaners, solvents, activators, stabilizers and the like while having a top spaced vertically downward from the font cabinet so as to provide a flat, even working surface on which fonts may be positioned while width cards are selected from the cabinet, or vice versa.

Accordingly the invention provides an apparatus by which a plurality of fonts and width cards may be safely retained in an orderly manner while simultaneously being readily available. These and other objects and advantages of the invention will be apparent from the following detailed description and the appended drawings.

DESCRIPTION OF THE PREFERRED EMBODIMENT

Figure 1:
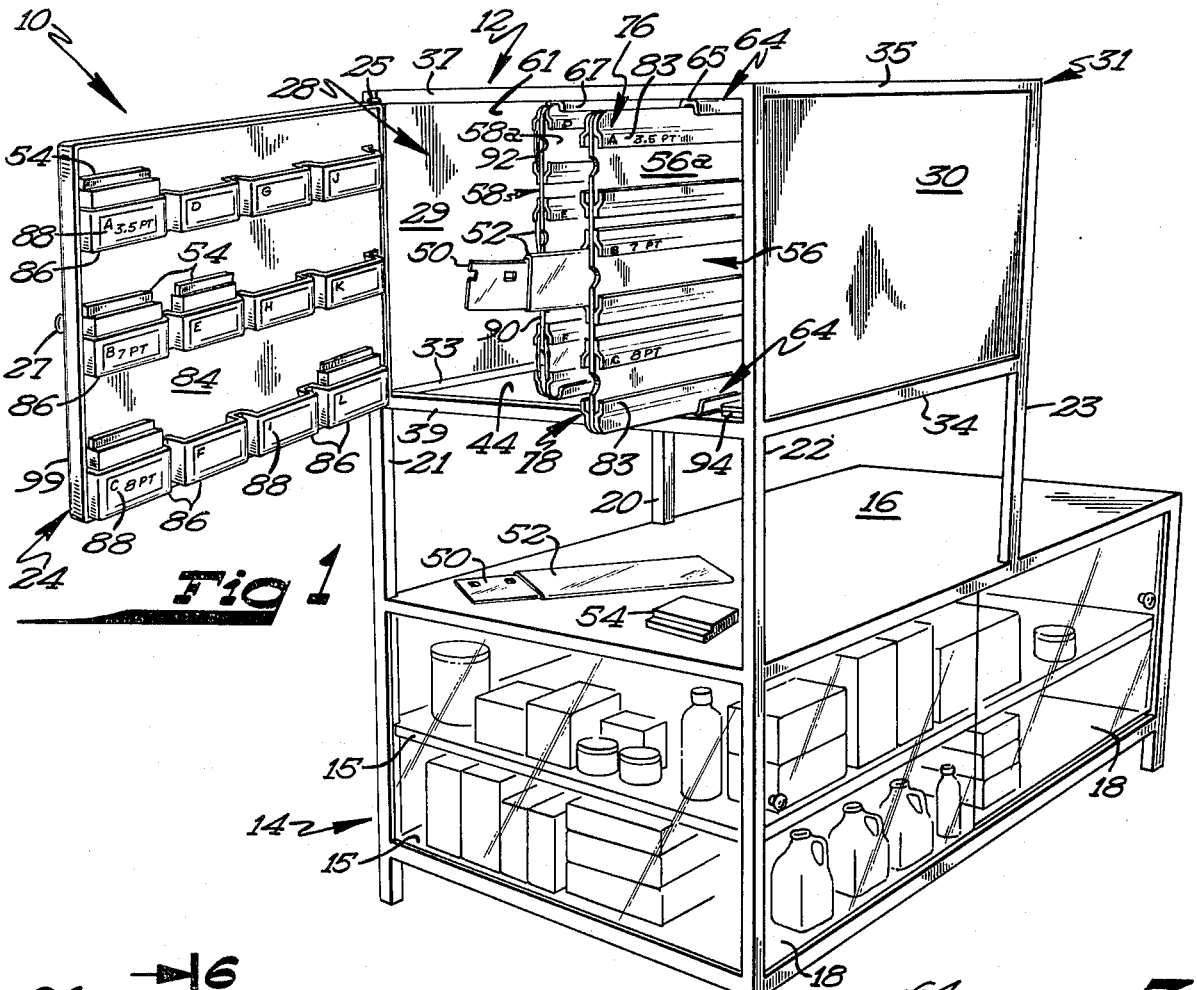
FIG. 1 is a perspective drawing of an embodiment of the invention.

Referring now to FIG. 1 of the drawings, the apparatus 10 for the storage and protection of phototypesetting equipment includes a cabinet or enclosure 12 carried by and preferably spaced upwardly from a lower storage cabinet 14, the top of which defines a generally flat working surface 16 on which a font 50 in its sheath 52 or a width card 54 may be placed.

The cabinet 14 may be of generally rectangular construction and is provided with interior shelves 15 on which standard cleaning and processing materials used in phototypesetting and photoprinting may be stored. Sliding, preferably transparent closure members 18 keep the inside of the cabinet 14 clear of dust but slide sidewardly to permit easy access to the cabinet interior. Preferably such closure members are provided on two or more sides of the lower cabinet 14 so that it may have its interior accessible from more than a single side. It sides may be formed of transparent material or alternatively may be formed of an opaque metal sheeting or the like.

The font enclosure 12 is firmly supported by generally upright posts 20, 21, 22 and 23, all of which are rigidly fixed to the lower cabinet 14 and which also define the vertical portion of the framework 31 of the enclosure 12. While the enclosure 12 is here shown as being of generally rectangular configuration, it should be understood that other shapes may be substituted, and such alternatives as would be apparent to one skilled in the art are within the purview of the invention.

Figure 2:
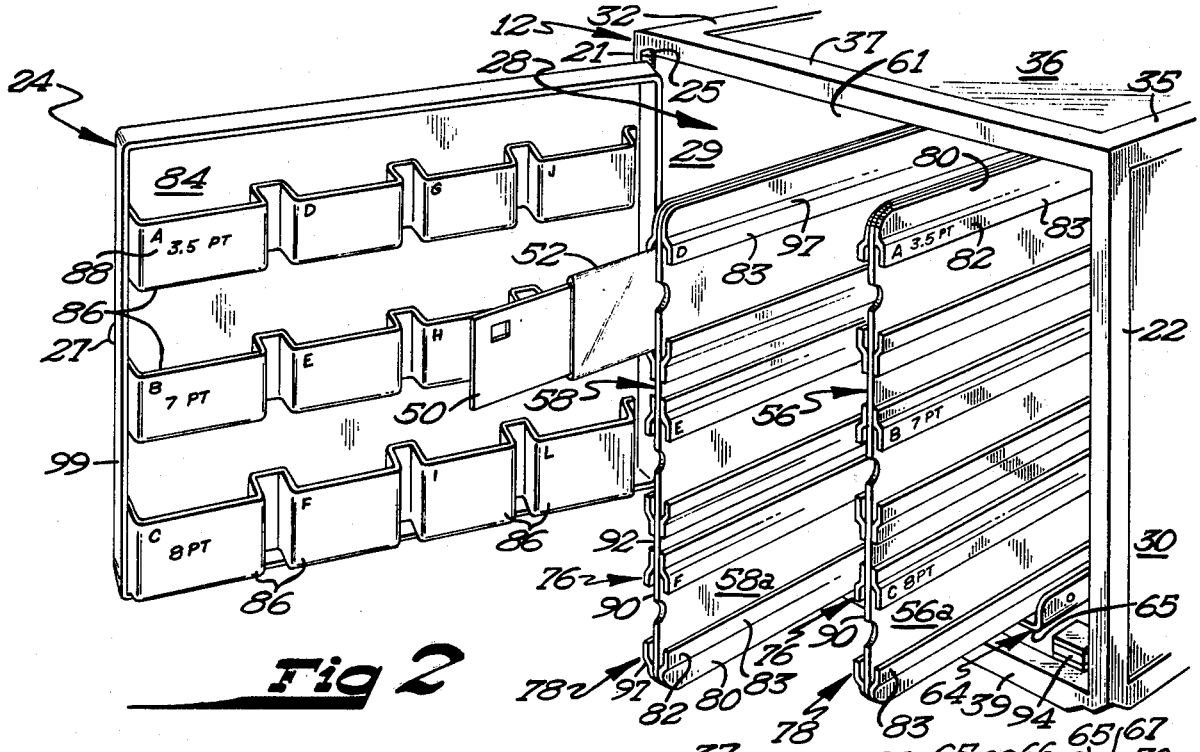
FIG. 2 is a perspective drawing of the upper cabinet of FIG. 1 showing the sliding panels in extended positions.

Referring now to FIG. 2 of the drawings, the enclosure 12 is provided with a swingable door 24 which is mounted to the enclosure 12 by hinges 25 and 26 to preferably swing about a generally vertical axis from a closed position 98 (FIG. 3) closely spaced from the panels 56 and 58 and obstructing access opening 61 to an open position (FIG. 2) permitting easy access to the interior chamber 28 of the enclosure 12.

The enclosure 12 has rigid, generally horizontal frame members 32, 33, 34, 35, 37, 39, 42 and 43 which extend between and are fixed to the generally upright posts 20–23 to define the framework 31 of the enclosure 12. Sidewall 29 is attached to members 21, 32, 20 and 33 in any known manner as, by way of example, welding the sidewall to the members, which provide a frame about the edges of the sidewall. Similarly, sidewall 30 is fixed to members 22, 35, 23 and 34, top 36 is fixed to members 37, 35, 39 and 32, bottom 44 is fixed to members 39, 34, 43 and 33, and rear wall 46 attached to members 23, 43, 20 and 42. Preferably the walls 29, 30, 36, 44 and 46 are formed of metal sheeting or other reasonably long lasting rigid material and in cooperation with the framework 31 collectively comprise a reasonably dust-tight enclosure in which fonts and sheaths may be stored, as will be further described hereafter. While a particular enclosure has been described it should be understood that other styles and types of enclosures may be substituted and are within the purview of the invention.

Because of the care which must be exercised in selecting and matching an appropriate font with the right width card, it is preferred that the enclosure 12 be positioned substantially at eye level, as shown in FIG. 1, to facilitate the careful inspection and examination needed to select the desired font and matched width card.

Mounted within the chamber 28 are one or more generally flat, upright, rigid panels such as panels 56 and 58 which are preferably rectangular in shape, formed of thin, rigid metal construction, and of a size capable of fitting wholly within the chamber 28 when the door 24 is in closed position 98.

Each of the panels 56 and 58 is movably mounted to the enclosure 12 at its top and bottom edges to permit freely sliding movement of the panels between a retracted position 60 wherein the panel is wholly within the enclosure 12 and an extended position 62 wherein the panel extends outwardly through the access opening 61 to permit an operator to easily inspect or select fonts carried on the panels, as will be described hereafter. Because each of the panels 56 or 58 is mounted to the enclosure 12 identically, only the mounting of panel 56 will be described in detail.

Figure 6:
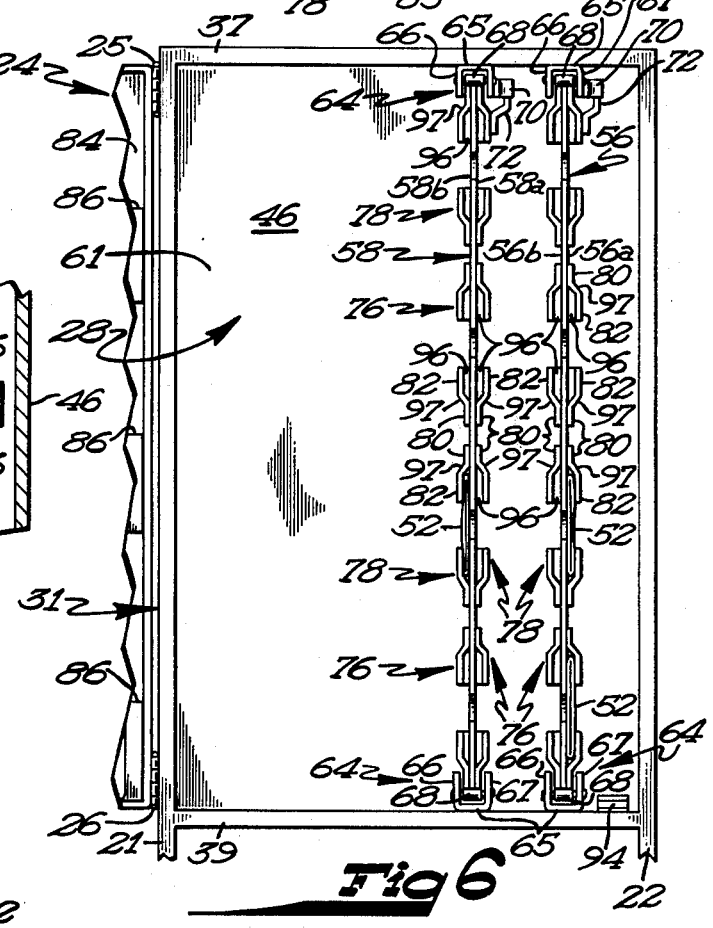
FIG. 6 is a front elevation view of the cabinet of FIG. 3 taken in the direction of arrows 6—6 of FIG. 3.
Figure 5:
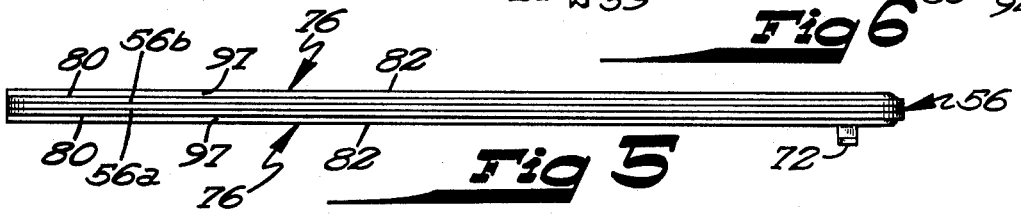
FIG. 5 is a top elevation view of a panel taken in the direction of arrows 5—5 of FIG. 3.

In the shown embodiment 10, track means are provided at the top and bottom of the enclosure 12 in the form of elongated channel members 64 which are mounted to top 36 and bottom 44 of the enclosure (FIG. 6). The members 64 each has a base 65, one channel member having its base 65 attached to the top 36 and the remaining elongated member having its base attached to the bottom 44 in any known manner. Each channel member 64 has lateral guides 66 and 67 to contain and guide the panels 56 or 58 therealong as the panels move between retracted and extended positions 60 an 62, respectively. If desired, the lateral side members 66 and 67 may rotatably support a plurality of rollers 68 therebetween which are positioned at regular intervals along the length of the members 64. These spaced rollers permit the panels 56 and 58 to freely roll between the extended and retracted positions and substantially reduce the effort needed to move them, and the lateral edges 66 and 67 contain each panel therebetween and guide it during movement.

It has been found desirable to provide a means to prevent forward over-travel of the panels in the direction 73 to prevent their inadvertent escape from the track means by providing an outwardly extending bar 70 which is attached to the lateral guide 67 and which interacts with outwardly and upwardly angling arm 72 which is carried on each panel 56 or 58. The arm 72 encounters the bar 70 only when the panel is in fully extended position 62, at which time the rigid arm 72 engages the bar 70 and prevents further forward travel of the panel 56 or 58 in the forward direction 73.

Figure 3:
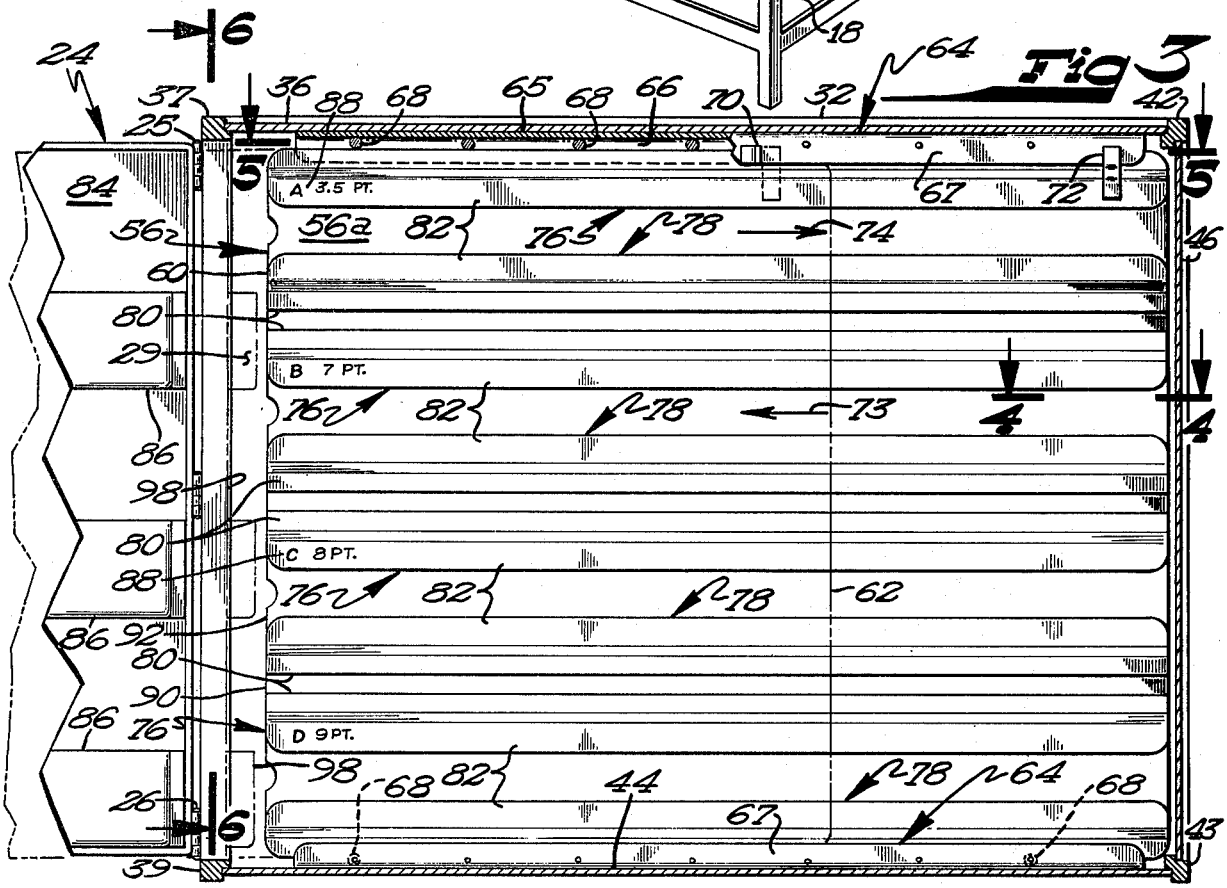
FIG. 3 is a cross sectional side elevation view of the cabinet of FIG. 2, also showing in phantom the extended position of the panels.

Referring now to FIGS. 2, 3, and 6, the panel 56 has obverse and reverse sides 56*a* and 56*b,* and the panel 58 has obverse and reverse sides 58*a* and 58*b.* On obverse and reverse sides of each panel are positioned a plurality of pairs of elongated strips such as strips 76 and 78, such strips being arranged in pairs with the strips of each pair being positioned generally horizontally and parallel and extending from the front to the rear of the panel. Each strip has a mounting flange 80 which is rigidly fixed to the panel in any known manner and each strip is provided with a font retaining web 82 which extends outwardly from the mounting flange 80 at an angle acute to the mounting flange, the web then angling toward the panel to define a section 83 which is generally parallel to the flat panel, resulting in each strip having a generally S-shaped cross sectional configuration.

The strips 76 and 78 of each pair are fixed to a side of the panel with their font retaining webs 82 confronting one another and spaced vertically apart. Each pair of strips defines a distinct, narrow, elongated, sheath-receiving compartment closely adjacent the panel and extending in a front-to-rearward direction in the chamber, each compartment being constructed to receive and closely confine a single sheath and font in a generally upright plane parallel to the panel, as best shown in FIGS. 2 and 6. The angled section 97 of the retaining web of lower strip 78 supports the sheath 52 and urges it toward the panel 56, causing it to contact and abut against the flat, even surface of the panel thereby protecting the font and sheath from bending or deforming.

By storing the font in an upright plane and keeping it generally flushly against the panel 56 or 58, the likelihood of dust accumulation on the font or its sheath is minimized and bending of the sheath or the enclosed font cannot occur.

Figure 4:
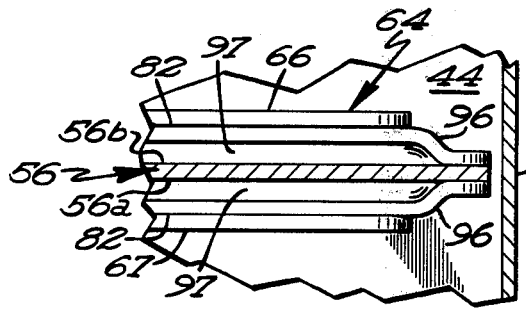
FIG. 4 is a cross sectional, partial top elevation view of the rear of a panel taken in the direction of arrows 4—4 of FIG. 3.

Referring now to FIG. 4, at the rearward end of each pair of strips 76 and 78 the font retaining web 82 is bent inwardly toward the panel 56 or 58 and contacts the panel to define a stop 96 to prevent over-travel of the sheath or font in rearward direction 74, thus effectively preventing any possible tearing, twisting, bending or scratching of a font or sheath between the panel and the rear wall 46. While FIG. 4 shows the lower strips 76 and 78 of two pairs of strips as having their webs 82 curved inwardly, it should be understood and will be readily apparent from FIG. 6 that the upper strips of each pair also have their webs curved inwardly. Accordingly, both the upper and lower cooperating strips which retain each sheath have stops 96 which engage the rearmost end of the sheath to prevent over-travel of the sheath in direction 74.

While only a single pair of the elongated strips has been discussed and described in detail, it should be understood and will appear from the drawings that a plurality of pairs of such strips are positioned on each side of the panels 56 and 58 and in the preferred embodiment pairs of such strips are positioned on both obverse and reverse side of each panel in vertically spaced rows. While only a pair of panels has been shown in the embodiment 10, it should be understood that additional panels, each provided with font retaining means on the obverse and reverse sides thereof may be added.

On the inner surface 84 of the door 24, a plurality of containers 86 are attached, each container 86 comprising a pouch-like, generally rectangular pocket adapted to receive and safely retain a width card. These containers may be formed in any way known to the art, but the shown structure wherein a plurality of containers are formed by stamping from an integral sheet of metal is economical and is preferred.

Referring now to FIG. 2, each of the containers 86 is provided with identifying indicia 88 bearing information including but not limited to a container designation and a description of the size and style of type for which the width card stored therein is designed. Identical identifying indicia 88 are attached to the font retaining means in which is stored the font used in association with such width card. Accordingly, an operator can select the font designed for the type and spacing required and immediately turn to the door 24 and remove the required width card with minimal error. No time is wasted in searching or sorting width cards or fonts. Each of the containers affixed to the door 24 bears appropriate identifying indicia to describe the width card contained therein, and all compartments within the enclosure are provided with corresponding indicia to indicate the font for each width card.

To keep the door in a closed position a magnetic latch 94 is provided just inside the access opening 61.

In operation, all fonts and width cards which are to be stored in the apparatus 10 are inserted. The fonts and protective sheaths are slidably inserted in the compartments carried by panels 56 and 58. The width cards associated with the fonts are positioned in the containers 86, which are attached to the door 24. Preferably each sheath receiving compartment is labeled with a letter or number and all width card containers 86 are similarly numbered so that by inspection the operator can immediately select the font and width card to be used together.

When a particular font and width card are desired, the operator goes to the enclosure 12 and swings the door 24 from closed position 98 to open position 99. The operator then manually grasps one or both of the panels 56 and 58, pulling them forwardly in the direction 73 through access opening 61 from their retracted position 60 to extended position 62, making it possible to easily examine and read the identifying indicia 88 associated with each sheath receiving compartment. The operator then can easily determine the sheath receiving compartment containing the required font; he grasps the desired sheath and font with his hand and slides them forwardly from the compartment in direction 73 until the font and sheath are fully withdrawn. He then places the sheath and font on the surface 16 and withdraws the width card needed for the already selected font.

When the operator pulls the panel 56 or 58 outwardly in direction 73, the panel slides freely outwardly with the lower edge 90 defined by the panel and attached strips (FIG. 6) rolling smoothly on the roller 68. Upright lateral guides 66 and 67 of channel 64 confine the panel to smoothly guide and direct the panel between retracted and extended positions. When the panel is moved to a fully extended position 62, the outwardly, upwardly extending arm 72 encounters bar 70 preventing further forward motion in the direction 73, thereby preventing the panel from being pulled entirely from the enclosure and becoming disconnected from the track means. When the panel is slidably returned from extended to retracted position, the rollers 68 and lateral edges 66 and 67 function as already described in containing and guiding the panel during movement and keeping it in a generally upright position. The panel 58 and its track means function identically to the operation already described in conjunction with panel 56.

When the selected font and width card are no longer needed, the operator reopens the door 24 and inserts the width card in its waiting container 86. He places the font 50 in its protective sheath 52. He then moves panel 56 from retracted to extended position and carefully holding the font, now enclosed in its protective sheath, he inserts the end of the sheath into the sheath receiving compartment provided by elongated strips 76 and 78. The font and sheath are then carefully slid in a rearward direction 74 until the leading edge of the sheath encounters the stops 96, which prevent any rearward overtravel of the sheath and font. The downwardly acutely angled section 97 of font retaining web 82 of strip 78 induces the font and sheath to slip downwardly and toward the flat, generally smooth panel 56 and to store flushly against obverse surface 56*a.* This positioning assures that bending of the font or sheath do not occur and that they will be contained in a generally flat condition free of damage. By storing the font and sheath in an upright orientation the likelihood of dust accumulation on the font or the sheath is greatly reduced. Upper, lower and rear edges of the font and sheath are protected by the font retaining webs 82 of strips 76 and 78, and by the stops 96 at the rear of each strip.

While the preferred embodiment of the present invention has been described, it should be understood that various changes, adaptations and modifications may be made therein without departing from the spirit of the invention and the scope of the appended claims.

What is claimed is:

1. An apparatus for the protection and storage of phototypesetting equipment including fonts and the protective sheaths in which fonts are carried comprising:

an enclosure having an access opening and an interior storage chamber fronting on said opening and extending rearwardly therefrom;

a generally upright panel having obverse and reverse sides and positioned within said chamber;

means movably mounting said panel to said enclosure for movement of said panel between a retracted position wherein said panel is wholly within said enclosure and an extended position wherein said panel protrudes from said enclosure through said access opening, said movable mounting means retaining said panel in a generally upright plane during movement between extended and retracted positions;

font retaining means fixed to said panel and in cooperation with said panel defining a plurality of distinct, narrow, elongated, sheath receiving compartments closely adjacent said panel and extending in a front-to-rearward direction in said chamber, each compartment being constructed and arranged to receive and closely confine a single sheath and font in a generally upright plane substantially parallel to said panel and between said retaining means and said panel and to substantially inhibit lateral movement and bending of the sheath and the font;

said font retaining means including a plurality of elongated strips positioned in pairs on said panel and extending from front to rear on said panel, each said strip having a mounting flange fixed to said panel and a font retaining web connected to said mounting flange and spaced laterally outwardly from said panel, a first strip of each pair of strips having its font retaining web extending downwardly and the second strip of each pair of strips being positioned below said first strip and having its font retaining web extending upwardly toward and confronting said font retaining web of said first strip so said font retaining webs of said first and second strips of each pair of strips cooperate to retain a font and protective sheath therebetween; and a door movably mounted to said enclosure for movement between an open position wherein said door is clear of said access opening and a closed position wherein said door fully obstructs said access opening to prevent dust from entering said chamber.

2. The apparatus for protection and storage of fonts according to claim 1 wherein said plurality of sheath receiving compartments are fixed to the obverse and reverse sides of said panel with said compartments being arranged in vertically spaced, generally horizontal rows.

3. The apparatus for protection and storage of fonts according to claim 1 wherein said font retaining web extends outwardly from said mounting flange at an angle acute to said mounting flange so that a font supported by said web will be urged toward and into contact with said panel.

4. The apparatus for protection and storage of fonts according to claim 1 wherein said font retaining means includes a plurality of stops, a stop being positioned at the rearward end of each said compartment to prevent fonts and their sheaths from slipping rearwardly from said sheath receiving compartments.

5. An apparatus for the protection and storage of phototypesetting equipment including fonts and the protective sheaths in which fonts are carried, comprising:

an enclosure having an access opening and an interior storage chamber fronting on said opening and extending rearwardly therefrom;

a plurality of generally upright panels positioned within said chamber and spaced laterally from one another;

means movably mounting each of said panels to said enclosure for movement of each of said panels between a retracted position, wherein the panel is wholly within said enclosure, and extended position, wherein the panel protrudes from said enclosure through said access opening, said movable mounting means retaining said panels in generally upright planes during movement between extended and retracted position;

font retaining means fixed to said panels and in cooperation with said panels defining a plurality of distinct, narrow, elongated sheath receiving compartments closely adjacent said panels and extending in a front-to-rearward direction in said chamber, each said compartment being constructed and arranged to receive and closely confine a single sheath and font in a generally upright plane substantially parallel to said panel and between said retaining means and a said panel and to substantially inhibit lateral movement and bending of the sheath and the font;

said font retaining means including a plurality of elongated strips positioned in pairs on said panels and extending from front to rear on each of said panels, each said strip having a mounting flange fixed to a said panel and a font retaining web connected to said mounting flange and spaced laterally outwardly from said panel, a first strip of each pair of strips having its font retaining web extending downwardly and the second strip of each pair of strips being positioned below said first strip and having its font retaining web extending upwardly toward and confronting said font retaining web of said first strip so said font retaining webs of said first and second strips of each pair of strips cooperate to retain a font and protective sheath therebetween; and a door movably mounted to said enclosure for movement between an open position wherein said door is clear of said access opening and a closed position wherein said door fully obstructs said access opening to prevent dust from entering said chamber.

6. The apparatus for protection and storage of fonts according to claim 5 wherein each of said elongated strips has an S-shaped cross-sectional configuration.

* * * * *